US008760308B2

(12) United States Patent
Piedmont

(10) Patent No.: US 8,760,308 B2
(45) Date of Patent: Jun. 24, 2014

(54) SURFACE TREATMENT PACE METER

(75) Inventor: Gregory Piedmont, Helendale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 294 days.

(21) Appl. No.: 13/281,380

(22) Filed: Oct. 25, 2011

(65) Prior Publication Data

US 2013/0099932 A1 Apr. 25, 2013

(51) Int. Cl.
*G08B 21/00* (2006.01)

(52) U.S. Cl.
USPC ..... 340/670; 340/540; 340/500

(58) Field of Classification Search
USPC ..... 340/670
See application file for complete search history.

(56) References Cited

U.S. PATENT DOCUMENTS

| | | | | |
|---|---|---|---|---|
| 5,043,548 | A | 8/1991 | Whitney et al. | |
| 5,452,854 | A | 9/1995 | Keller | |
| 6,197,386 | B1 | 3/2001 | Beyer et al. | |
| 2004/0074072 | A1 | 4/2004 | Iwata | |
| 2006/0165140 | A1* | 7/2006 | Tan et al. | 372/33 |
| 2007/0023408 | A1 | 2/2007 | Yuk Man | |
| 2008/0066596 | A1 | 3/2008 | Yamaguchi et al. | |
| 2010/0198134 | A1* | 8/2010 | Eckhouse et al. | 604/20 |
| 2010/0256489 | A1* | 10/2010 | Pedersen et al. | 600/439 |
| 2011/0151270 | A1 | 6/2011 | Rockstroh et al. | |
| 2011/0206533 | A1* | 8/2011 | Lee et al. | 416/241 R |
| 2011/0216188 | A1* | 9/2011 | Thwing et al. | 348/135 |

FOREIGN PATENT DOCUMENTS

| | | | |
|---|---|---|---|
| JP | 403107447 | A | 5/1991 |
| JP | 411192559 | A | 7/1999 |

OTHER PUBLICATIONS

Mates et al., "Calibration of a Two-Color Imaging Pyrometer and Its Use for Particle Measurements in Controlled Air Plasma Spray Experiments", Journal of Thermal Spray Technology, Jun. 2002, pp. 195-205, vol. 11, No. 2.

Dykhuizen et al., "Process-Based Quality for Thermal Spray via Feedback Control", Journal of Thermal Spray Technology, Sep. 2006, pp. 332-339, vol. 15, No. 3.

* cited by examiner

*Primary Examiner* — Kerri McNally
(74) *Attorney, Agent, or Firm* — McDermott Will & Emery LLP

(57) ABSTRACT

A system for providing feedback to an operator regarding a speed at which the operator is passing a treatment device over a surface compared to an ideal speed is disclosed. The system includes a reference module configured to provide an optical beam, a sensing module configured to detect the optical beam and providing a signal related to a speed of the optical beam passing over the sensing module, and an electronics module configured to receive the signal from the sensing module and provide an indication of whether the speed of the beam is less than, equal to, or greater than an ideal speed.

24 Claims, 4 Drawing Sheets

SURFACE TREATMENT PACE METER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field

The present disclosure generally relates to systems and methods of applying a treatment to a surface and, in particular, manually applying a uniform plasma treatment to a surface.

2. Description of the Related Art

Surfaces of some materials must be treated to improve properties of the surface prior to operations such as bonding. One traditional method of surface treatment is use of a gas plasma stream to activate the material on the surface, wherein a plasma is created by an arc operating at a frequency in the kilohertz to megahertz range. Treating a surface using a gas plasma stream requires that a delicate balance must be maintained with regard to the type and amount of gas provided as well as the voltage of the arc and the distance that the plasma has to travel from the plasma gun nozzle to the surface being treated. Other types of surface treatment include plasma spray treatment where a feedstock material, such as a ceramic or oxide, is introduced into a plasma jet created by a high-voltage arc and thereby melted and driven toward the surface where the feedstock material is deposited as a coating. These types of surface treatment are typically carried out in a robotically controlled environment, such as the robotic work station depicts in FIG. 1, so as to provide the control and repeatability required for successful treatment of the surface.

It is sometimes necessary to apply a gas plasma or other type of surface treatment to a surface that is located within a structure or in the field as part of a repair. It is very difficult to accomplish this type of surface treatment using a robotic system. Manual application of a surface treatment requires that the treatment device be passed over the surface to be treated at a constant distance and at a constant speed. This is, at best, difficult to accomplish even with a skilled operator. In addition, variations in technique between different operators may lead to variations in the surface treatment, leading to variable results in the overall results of the process.

SUMMARY

There is a need for a surface treatment system that is as easy to use as a paint spraying system and capable of providing uniform and predictable results when used by multiple operators. The most difficult operational variable to control is the speed of movement of the treatment device over the surface to be treated.

The systems and methods disclosed herein provide feedback to an operator who is manually applying a surface treatment using a treatment device, such as a plasma sprayer. A reference module, such as a laser pointer, is attached to the treatment device and emits an optical beam, and a sensing module is positioned adjacent to the surface to be treated. As the operator moves the treatment device over the surface, the optical beam strikes the sensing module which detects the speed of the optical beam across the sensing module. The sensing module includes a feedback indicator, such as a variable color light wherein the color of the light changes to indicate whether the operator is moving the treatment device at the proper speed. This feedback enables the operator to maintain the proper speed of the treatment device.

In certain embodiments, a system for providing feedback to an operator regarding a speed at which the operator is passing a treatment device over a surface compared to an ideal speed is disclosed. The system includes a reference module configured to provide an optical beam, a sensing module configured to detect the optical beam and providing a signal related to a speed of the optical beam passing over the sensing module, and an electronics module configured to receive the signal from the sensing module and provide an indication of whether the speed of the beam is less than, equal to, or greater than an ideal speed.

In certain embodiments, a system for providing feedback to an operator regarding a speed at which the operator is passing a treatment device over a surface compared to an ideal speed is disclosed. The system includes a reference module configured to be coupled to the treatment device and provide an optical beam and a sensing module that includes a grating configured to be disposed such that the optical beam strikes the grating as the treatment device is passed over the surface. The grating has a plurality of transmissive regions arranged in a row and separated by opaque regions. The sensing module also includes a detector coupled to the grating. The detector is configured to detect whether the optical beam has passed through a transmissive region of the grating and providing a signal indicating whether the beam has passed through the grating. The system also includes an electronics module that includes an indicator and a processor coupled to the detector and the indicator. The processor is configured to accept the signal from the detector, calculate the speed of the treatment device, and actuate the indicator to indicate whether the calculated speed is less than, equal to, or greater than the ideal speed.

In certain embodiments, a system for treating a surface is disclosed. The system includes a treatment device configured to treat the surface when passed over the surface at an ideal speed. The system also includes a reference module configured to be coupled to the treatment device and provide an optical beam and a sensing module that includes a grating configured to be disposed such that the optical beam strikes the grating as the treatment device is passed over the surface. The grating has a plurality of transmissive regions arranged in a row and separated by opaque regions. The sensing module also includes a detector coupled to the grating. The detector is configured to detect whether the optical beam has passed through a transmissive region of the grating and providing a signal indicating whether the beam has passed through the grating. The system also includes an electronics module that includes an indicator and a processor coupled to the detector and the indicator. The processor is configured to accept the signal from the detector, calculate the speed of the treatment device, and actuate the indicator to indicate whether the calculated speed is less than, equal to, or greater than the ideal speed.

In certain embodiments, a method of providing feedback to an operator regarding the speed at which the operator is passing a treatment device over a surface compared to an ideal speed is disclosed. The method includes the steps of emitting an optical beam from a reference module coupled to the treatment device, passing the optical beam over a sensing module as the treatment device is passed over the surface, calculating with a processor a calculated speed at which the optical beam is being passed over the sensing module, and proving an indication of whether the calculated speed is less than, equal to, or greater than an ideal speed.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

The following description discloses embodiments of a system for providing feedback to an operator regarding a speed at which the operator is passing a treatment device over a surface compared to an ideal speed.

Within this disclosure, the phrase "optical" covers electromagnetic radiation from ultraviolet to infrared, including wavelengths in the range of 10 nanometers to 1 millimeter. Within this disclosure, the phrase "visible" covers light visible to the human eye, including wavelengths in the range of 380-760 nanometers. Within this disclosure, the phrase "audible" covers sounds that can be perceived by the human ear, including frequencies in the range of 20 Hz-20 kHz.

In the following detailed description, numerous specific details are set forth to provide a full understanding of the present disclosure. It will be apparent, however, to one ordinarily skilled in the art that embodiments of the present disclosure may be practiced without some of the specific details. In other instances, well-known structures and techniques have not been shown in detail so as not to obscure the disclosure.

The method and system disclosed herein are presented in terms of a handheld plasma sprayer. This exemplary utilization of the disclosed system is sufficient to describe the attributes and use of the components of a variety of embodiments of the system. Utilization of the disclosed system is not limited to plasma sprayers, however, and advantageous application may be found in other systems wherein it is desirable for an operator to move a handheld device at a constant speed. Nothing in this disclosure shall be interpreted to limit the application of the disclosed systems and processes to plasma spraying unless explicitly stated as such.

Figure 1:
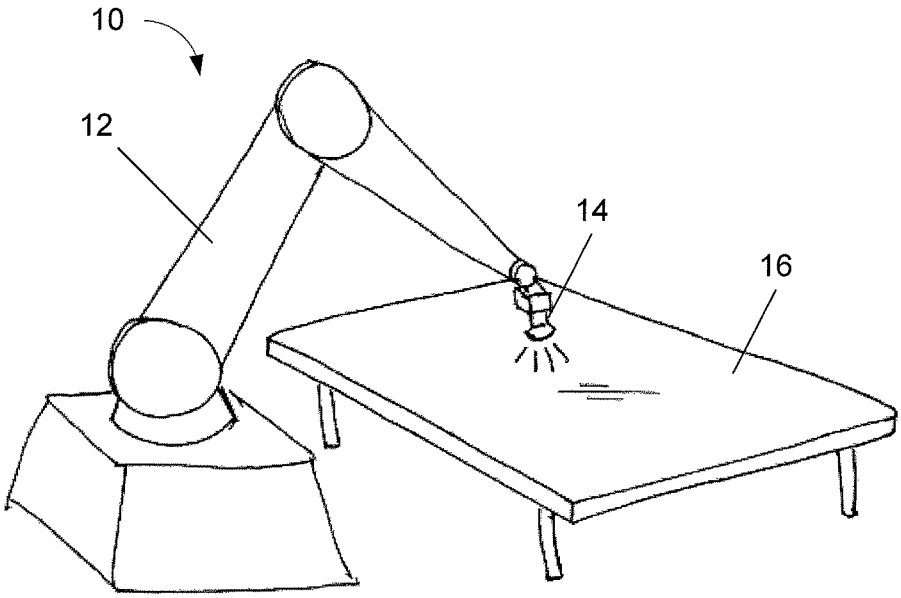
FIG. 1 depicts a work cell configured to apply a surface treatment using a robotic arm.

FIG. 1 depicts a work cell 10 configured to apply a surface treatment using a robotic arm 12. The surface 16 to which the surface treatment is to be applied is presented in a defined and convenient location relative to the robotic arm 12. The robotic arm 12 is able to move the plasma sprayer 14 over the entire surface 16 at a constant distance and speed, thereby providing the desired degree of treatment.

Figure 2:
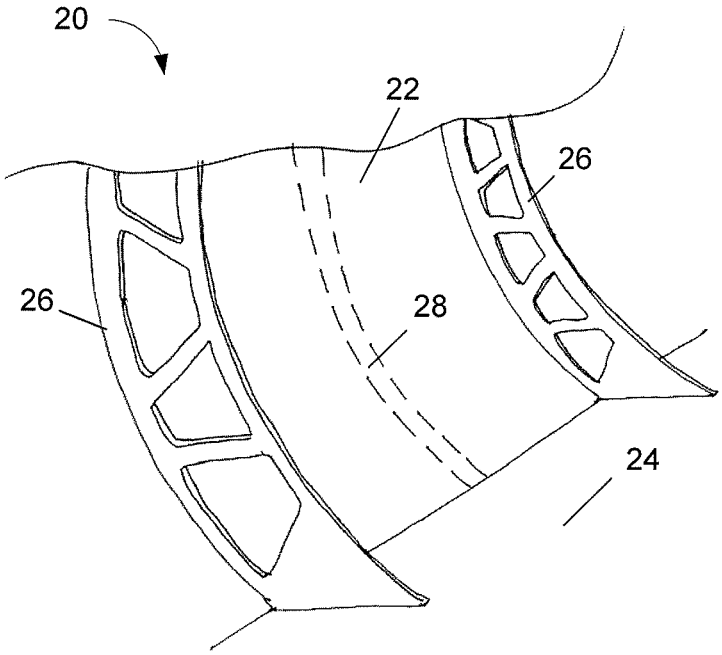
FIG. 2 depicts an example of a situation wherein it is necessary for an operator to manually apply a surface treatment according to certain aspects of this disclosure.

FIG. 2 depicts an example of a situation wherein it is necessary for an operator to manually apply a surface treatment according to certain aspects of this disclosure. This example is a repair being made inside the fuselage of an aircraft 20. The fuselage includes an outer skin 22 with structural trusses 26 located at intervals and a floor 24. A replacement truss 26 (not shown) is to be bonded to the outer skin 22 in the area of surface 28, the boundaries of which are indicated by the dashed lines. In this example, adhesion of the replacement truss 26 to the outer skin 22 will be improved by treating the surface 28 with a plasma sprayer prior to the bonding operation. Bringing in a robotic system to accomplish the surface treatment in this situation would be both difficult and expensive, and so an operator will manually apply the surface treatment using a handheld plasma sprayer assisted by the pace meter disclosed herein.

Figure 3:
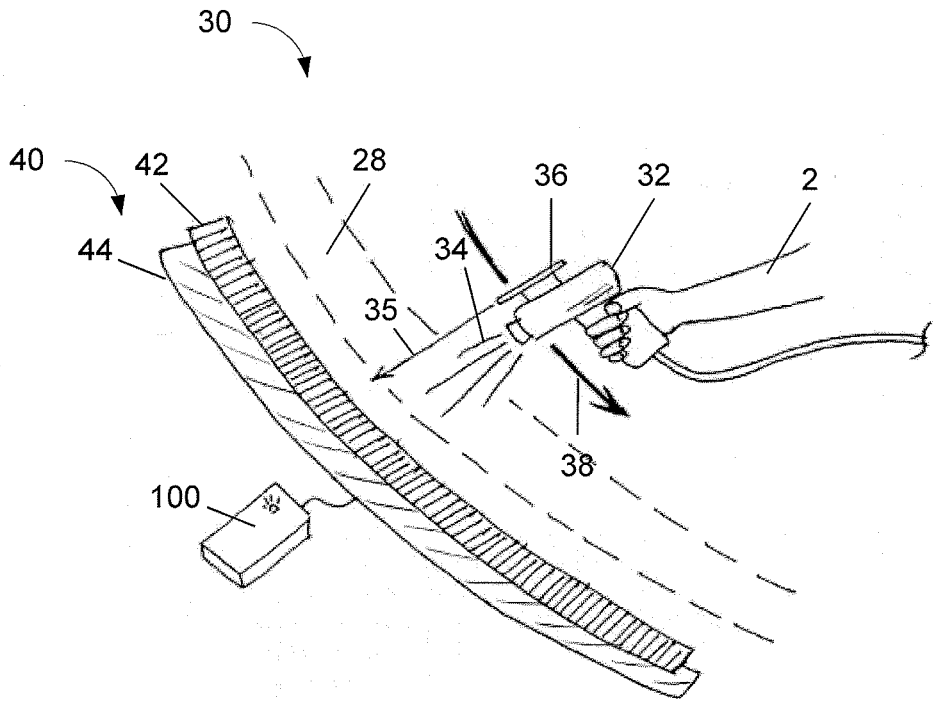
FIG. 3 depicts an exemplary surface treatment pace metering system according to certain aspects of this disclosure.

FIG. 3 depicts an exemplary surface treatment pace metering system 30 according to certain aspects of this disclosure. The pace metering system 30 is adapted, in this example, to work with a plasma sprayer 32 being manipulated by an operator 2. The plasma sprayer emits a plasma stream 34 that is to be directed over the surface 28 of FIG. 2 by moving the plasma sprayer 32 in the direction of arrow 38. The system 30 comprises a reference module 36 that emits an optical beam 35 that, in this example, is a beam of laser light in the visible spectrum. In certain embodiments, the reference module 36 is a laser pointer. The reference module is coupled to the plasma sprayer 32 such that the optical beam 35 is generally directed in the same direction as the plasma stream 34 with an offset angle between the plasma stream 34 and optical beam 35 for reasons that are discussed below.

The system 30 also comprises a sensing module 40 that is positioned next to the surface 28 to be treated. The sensing module 40 comprises a grating 42 and a detector 44. The construction and operation of the sensing module are discussed in greater detail with respect to FIG. 4. The reference module 36 is configured such that the optical beam 35 moves across the length of the sensing module as the operator 2 passes the plasma sprayer 32 over the area 28. The sensing module 40 provides a signal that comprises information related to the speed at which the operator 2 is moving the plasma sprayer 32 over the surface 28. The sensing module 40 is coupled to an electronics module 100 that includes, in this embodiment, a light 102 that is configured to emit light at a selectable frequency.

Figure 5:
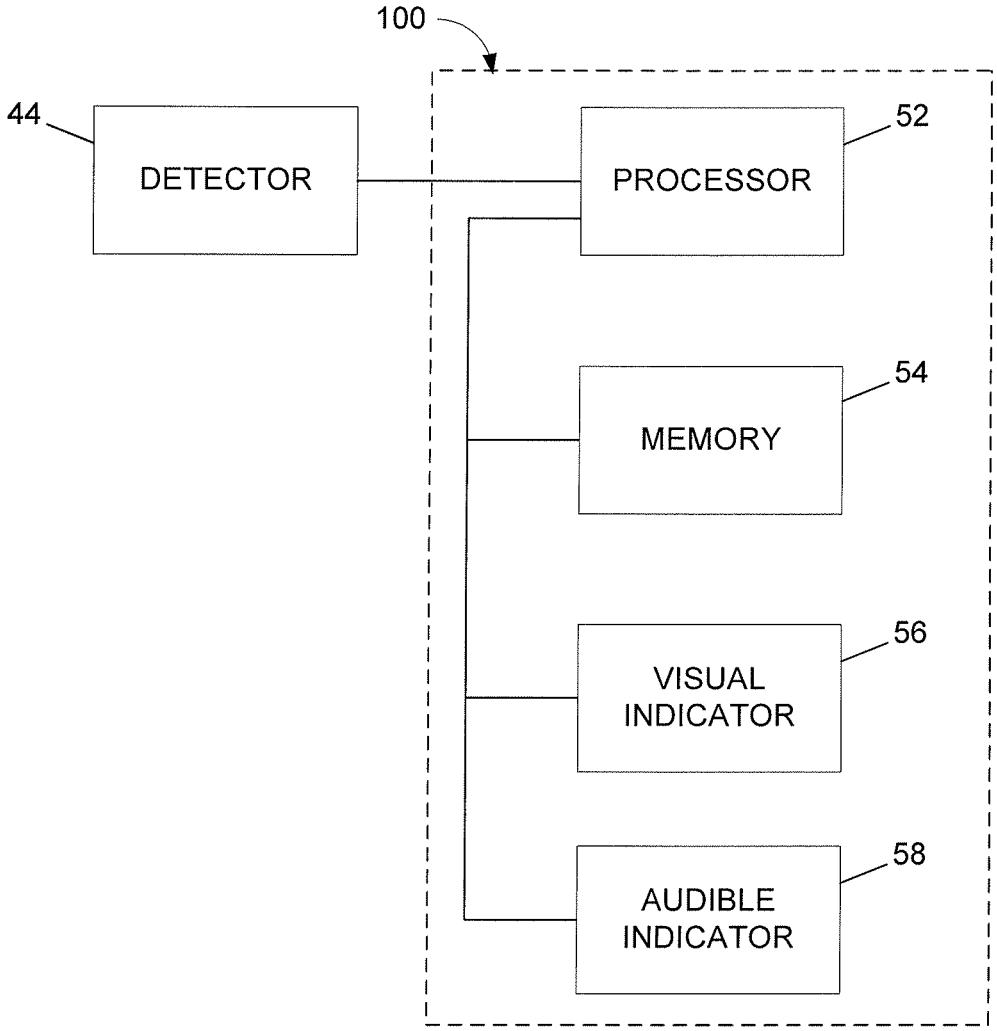
FIG. 5 is a block diagram of an exemplary electronics module according to certain aspects of this disclosure.

The electronics module 100 is discussed in greater detail with respect to FIG. 5. In summary, the electronics module calculates the difference between the actual speed of the sprayer and an ideal speed and actuates the light 102 according to this difference. In this embodiment, the light 102 emits a green light when the operator is moving the plasma sprayer at approximately the correct speed. In this example, the frequency of the emitted light shifts toward the blue if the actual speed is less than the ideal speed, with the frequency shift proportional to the error in speed. Similarly, in this example, the frequency of the emitted light shifts toward the red if the actual speed is greater than the ideal speed, with the frequency shift proportional to the error in speed. In certain embodiments, the light 102 emits light in a first frequency range when the actual speed is within an acceptable range about the ideal speed, in a second frequency range when the actual speed is less than the acceptable range, and in a third frequency range when the actual speed is greater than the acceptable range. In certain embodiments, the emitted light is a single frequency in each of the frequency ranges. In certain embodiments, the first and third frequency ranges are identical. In certain embodiments, the frequency of the emitted light is related to the actual speed in a monotonic relationship, i.e. the increase in the frequency of the emitted light increases in a linear or non-linear fashion as the actual speed becomes increasingly greater than the ideal speed but the frequency would decrease over any interval of frequency as the actual speed increases.

Figure 4A:
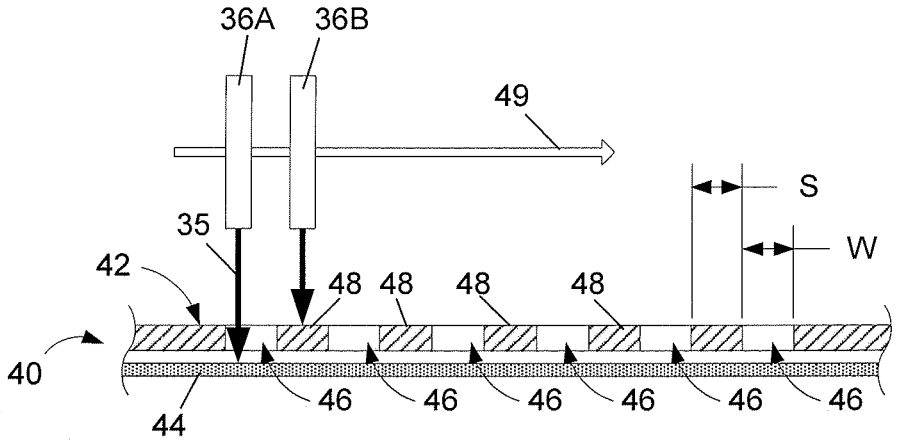
FIG. 4A depicts a schematic cross-section of an exemplary sensing module according to certain aspects of this disclosure.

FIG. 4A depicts a schematic cross-section of an exemplary sensing module 40 according to certain aspects of this disclosure. The sensing module 40 comprises a grating 42 having a series of transmissive portions 46 that are, in this example, open slots arranged in a row. The transmissive portions 46 are uniform in width W and are separated by opaque regions 48 at a uniform spacing S. The phrases "transmissive" and "opaque" as used here are relative to the frequency of the optical beam 35. For example, if the optical beam 35 comprised an infrared light that is not visible to the human eye, i.e. having a wavelength above 760 nanometers, then the opaque region 48 may appear transparent to the human eye while blocking the infrared light of the optical beam 35. Disposed beneath, in the orientation of FIG. 4A, is a detector 44 configured to detect the frequency of light of the optical beam 35. When the reference module 36 is located at position 36A, the optical beam 35 passes through one of the transmissive regions 46 and reaches the detector 44. When the reference module 36 is located at position 36B, the optical beam 35 is blocked by one of the opaque regions 46 and therefore does not reach the detector 44. The detector is configured to provide a indication of whether the beam has passed through the grating and reached the detector 44. This signal is discussed in greater detail with respect to FIG. 4B. As the plasma sprayer 32 of FIG. 3 (not shown in FIG. 4A) is passed over the surface 28, reference module 36 will move relative to the sensing module 40 as indicated by the arrow 49 and the optical beam 35 will alternately pass through a transmissive region 46 and be blocked by an opaque region 48.

In certain embodiments, the width W of the transmissive regions 46 is greater than a diameter of the optical beam 35 such that the entire beam 35 passes through a transmissive portion 46 at some point as the optical beam 35 passes across the transmissive portion 46. In certain embodiments, the width W of the transmissive regions 46 is less than the diameter of the optical beam 35. In certain embodiments, the separation S between the transmissive portions 46 is greater than the diameter of the optical beam 35.

In certain embodiments, the detector 44 comprises a plurality of individual sensing elements (not shown) that are respectively arranged under the transmissive regions 46 and individually report whether the optical beam is passing the transmissive region 46 above the respective individual sending element.

Figure 4B:
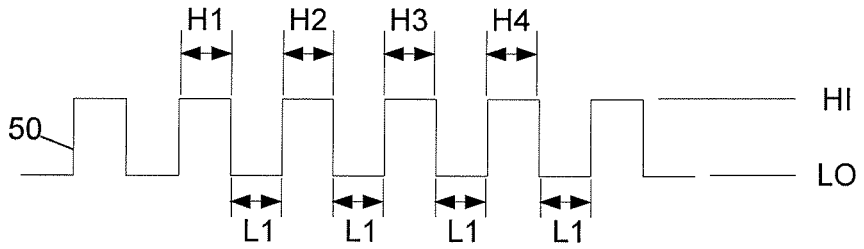
FIG. 4B depicts an exemplary signal provided by the detector of FIG. 4A according to certain aspects of this disclosure.

FIG. 4B depicts an exemplary signal 50 provided by the detector 44 of FIG. 4A according to certain aspects of this disclosure. When the optical beam 35 reaches the detector 44, the signal 50 is in a "HI" state. When the optical beam 35 is not striking the detector 44, i.e. is blocked by an opaque region 48, the signal 50 is in a "LO" state. Provision of a two-state signal wherein the HI and LO states are each associated with a respective range of the signal medium is known to those of skill in the art. In the example of an electronic signal, the HI and LO states each have a defined range of voltage with respect to a reference line (not shown in FIG. 4B). The durations of the sequential HI and LO states are respectively indicated as H1, H2, H3, etc. and L1, L2, L3, etc. in FIG. 4B.

With reference to the embodiment of FIG. 4A, wherein the width W and the spacing S are equal, the signal 50 will comprise a square wave with HI and LO states both having a certain duration if the optical beam 35 passes across the sensing module 40, which is presumed to be approximately the same as the speed of the plasma sprayer 32 passing over the surface 28, is moving at a constant speed. If the speed of the plasma sprayer 32 decreases as the operator 2 moves the plasma sprayer 32 over the surface 28, the durations H2 and L2 will be greater than H1 and L1, respectively, and the duration H3 and L3 will likewise be greater than H2 and L2, respectively.

FIG. 5 is a block diagram of an exemplary electronics module 100 according to certain aspects of this disclosure. The electronics module 100 comprises a processor 52 that is coupled to the detector 44 and to a memory 54 and at least one of a visual indicator 56 and an audible indicator 58. In certain embodiments, the visual indicator is configured to emit light at a selectable frequency. In certain embodiments, the visual indicator is configured to intermittently emit light at a selectable frequency, wherein the durations of emitting light and not emitting light are selectable. In certain embodiments, the visual indicator comprises a plurality of selectively illuminated indicators wherein a portion of the plurality can be illuminated while the remaining selectively illuminated indicators are not illuminated. In certain embodiments, the audible indicator is configured to emit sound at a selectable frequency. In certain embodiments, the audible indicator is configured to intermittently emit sound at a selectable frequency, wherein the durations of emitting sound and not emitting sound are selectable.

In certain embodiments, the processor 52 is configured to retrieve executable instructions from the memory 54 and execute the retrieved instructions. The processor 52 is configured to accept the signal 50 from the detector 44 and calculate the current actual speed of the optical beam 35 moving over the sensing module 40, which is presumed to be very close to the speed of the plasma sprayer 32 passing over the surface 38, and compare this calculated actual speed to an ideal speed that is retrieved from the memory 54. Systems and methods of entering a value of the ideal speed in the memory are known to those of skill in the art. The processor 52 is further configured to actuate the at least one of the visual indicator 56 and audible indicator 58 to indicate whether the calculated speed is less than, equal to, or greater than the ideal speed.

In certain embodiments, the processor 52 is configured to cause the visual indicator 56 to emit light of a specified frequency in response to the relationship between the calculated speed and the ideal speed. In certain embodiments, the processor 52 is configured to cause the indicator 56 to emit light at a frequency that is monotonically related to the calculated speed. In certain embodiments, the processor 52 is configured to cause a portion of the selectively illuminated indicators to be illuminated, wherein the number of selectively illuminated indicators that are illuminated is monotonically related to the calculated speed.

Figure 6:
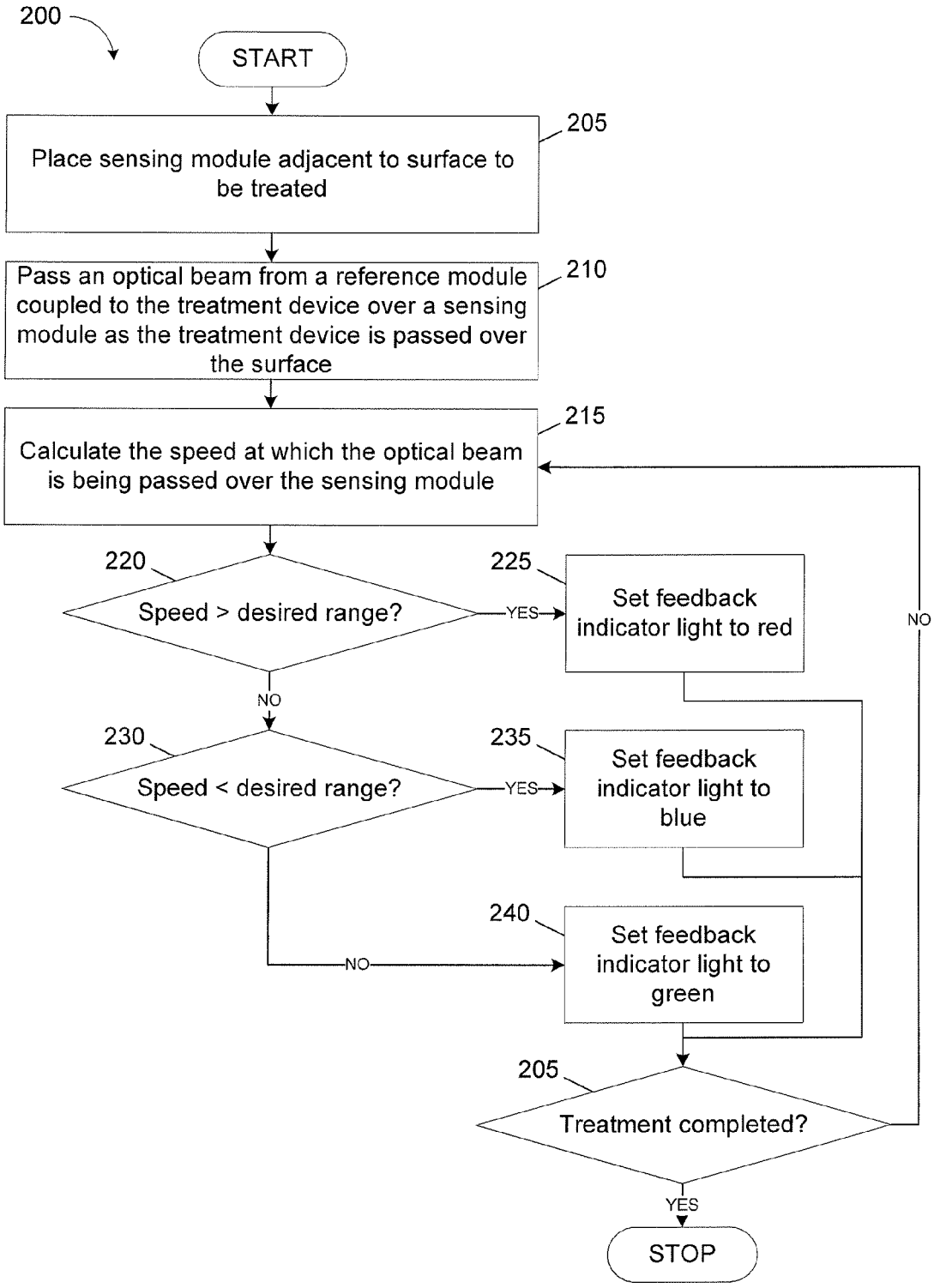
FIG. 6 is a flowchart of an exemplary method of use of the surface treatment pace metering system according to certain aspects of this disclosure.

FIG. 6 is a flowchart of an exemplary method 200 of use of the surface treatment pace metering system 30 according to certain aspects of this disclosure. The method is illustratively described with reference to the embodiment of FIG. 3 but is not limited to this embodiment. The method of use starts in step 205 with the placement of sensing, module 40 adjacent to the surface 28 that is to be treated. As the treatment device, such as plasma sprayer 32, is passed over the surface 28 in step 210, an optical beam 34 from a reference module 36 is passed over the sensing module 40. In step 215, the electronic module 100 receives a signal from the sensing module 40 and calculates the speed of movement of the plasma sprayer 32 over the surface 28. In steps 220 and 230, the electronics module 100 determines whether the speed of movement is greater than or less than a desired range of speed. If the speed is determined to be greater than the desired range in step 220, the process branches along the 'yes' path to step 225 wherein the electronics module 100 sets a feedback indicator light to emit red light. This use of a colored light as a feedback indicator and the color of light emitted for certain conditions are non-limiting examples of a feedback indicator. If the speed is determined to be less than or equal to the desired range in step 220, the process branches along the 'no' path to decision point 230 wherein the electronics module 100 determines whether the speed of movement is less than the desired range of speed. If the speed is determined to be less than the desired range in step 230, the process branches along the 'yes' path to step 235 wherein the electronics module 100 sets a feedback indicator light to emit blue light. If the speed is within the desired range, the process branches along the 'no' path to step 240 wherein the electronics module 100 sets a feedback indicator light to emit green light. After the color of the indicator light has been set in any of steps 225, 235, or 240, the process moves to step 245 wherein it is determined whether the treatment is completed. In certain embodiments, this determination comprises a determination of whether the optical beam 34 is still being detected by the sensing module 40. If the treatment is not completed, the process branches along the 'no' path and returns to step 215 to calculate a new speed. The process continues around the loop 215-220-230-240-245, or along one of the parallel paths through steps 225 or 235, until the treatment is completed. When the treatment is determined to be completed in step 245, the process branches along the 'yes' path to the process terminator.

In certain embodiments, the feedback indicator is a series of selectively illuminated lights, wherein steps 225, 235, and 240 determine which of the lights to illuminate. In certain embodiments, the feedback indicator is an audible tone and steps 225, 235, and 240 determine what frequency of sound to emit.

The concepts disclosed herein provide a system and method of providing feedback to an operator regarding a speed at which the operator is passing a treatment device over a surface compared to an ideal speed. The system includes a reference module that is attached to the treatment device and a sensing module that is positioned adjacent to the surface to be treated. The reference module is adjusted such that an optical beam emitted by the reference module passes across the sensing module as the treatment device is passed over the surface. The sensing module provides a signal to an electronics module that provides actuates an indicator to indicate whether the calculated speed of the treatment device over the surface is less than, equal to, or greater than the ideal speed.

It will be obvious to those of skill in the art that the various elements of the disclosed embodiments of the present disclosure may be used to provide feedback to an operator with respect to other types of manually manipulated devices that must be moved at a specified rate. Such devices may include paint sprayers, cameras, or sensors that are in contact with or spaced apart from a surface or used in free space without regard to a surface.

The previous description is provided to enable a person of ordinary skill in the art to practice the various aspects described herein. While the foregoing has described what are considered to be the best mode and/or other examples, it is understood that various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the terms "a set" and "some" refer to one or more. Pronouns in the masculine (e.g., his) include the feminine and neuter gender (e.g., her and its) and vice versa. Headings and subheadings, if any, are used for convenience only and do not limit the invention.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A system for providing feedback to an operator regarding a speed at which the operator is passing a treatment device over a surface compared to an ideal speed, the system comprising:

a reference module, coupled to the treatment device, configured to provide an optical beam;

a sensing module, separate and spaced apart from the treatment device, configured to detect the optical beam and providing a signal related to a speed of the optical beam passing over the sensing module; and an electronics module configured to receive the signal from the sensing module and provide an indication of whether the speed of the beam is less than, equal to, or greater than an ideal speed.

2. The system of claim 1, wherein the sensing module comprises:

a grating configured to be disposed such that the optical beam strikes the grating as the treatment device is passed over the surface, the grating comprising a plurality of transmissive regions arranged in a row and separated by opaque regions; and a detector coupled to the grating, the detector configured to detect whether the optical beam has passed through a transmissive region of the grating and providing a signal indicating whether the beam has passed through the grating.

3. The system of claim 2, wherein the electronics module comprises:

an indicator; and a processor coupled to the detector and the indicator, the processor configured to accept the signal from the detector, calculate the speed of the treatment device, and actuate the indicator to indicate whether the calculated speed is less than, equal to, or greater than the ideal speed.

4. The system of claim 3, wherein the indicator comprises an optical indicator.

5. The system of claim 4, wherein:

the optical indicator is configured to emit visible light at a selectable frequency; and the processor is further configured to cause the indicator to emit light at a frequency that is monotonically related to the calculated speed.

6. The system of claim 4, wherein:

the optical indicator comprises a plurality of selectively illuminated indicators;

the processor is further configured to cause a portion of the plurality of indicators to be illuminated; and the portion of the plurality of indicators that are illuminated is monotonically related to the calculated speed.

7. The system of claim 3, wherein the indicator comprises an audible indicator.

8. The system of claim 7, wherein:

the audible indicator is configured to emit sound at a selectable frequency; and the processor is further configured to cause the audible indicator to emit sound at a frequency that is monotonically related to the calculated speed.

9. The system of claim 2, wherein the transmissive regions are configured as parallel slots.

10. The system of claim 2, wherein the transmissive regions are configured as parallel strips having a common width and a common length.

11. The system of claim 10, wherein the width of the transmissive strips is greater than a diameter of the optical beam.

12. The system of claim 11, wherein a common separation distance between the transmissive strips is greater than a diameter of the optical beam.

13. The system of claim 1, wherein the optical beam is a beam of coherent light.

14. The system of claim 1, wherein the treatment device is a hand-held plasma sprayer.

15. A system for providing feedback to an operator regarding a speed at which the operator is passing a treatment device over a surface compared to an ideal speed, the system comprising:

a reference module configured to be coupled to the treatment device and provide an optical beam;

a sensing module comprising:

a grating configured to be disposed such that the optical beam strikes the grating as the treatment device is passed over the surface, the grating comprising a plurality of transmissive regions arranged in a row and separated by opaque regions;

a detector coupled to the grating, the detector configured to detect whether the optical beam has passed through a transmissive region of the grating and providing a signal indicating whether the beam has passed through the grating; and an electronics module comprising:

an indicator; and a processor coupled to the detector and the indicator, the processor configured to accept the signal from the detector, calculate the speed of the treatment device, and actuate the indicator to indicate whether the calculated speed is less than, equal to, or greater than the ideal speed.

16. A system for treating a surface, the system comprising:

a treatment device configured to treat the surface when passed over the surface at an ideal speed;

a reference module configured to be coupled to the treatment device and provide an optical beam;

a sensing module comprising:

a grating configured to be disposed such that the optical beam strikes the grating as the treatment device is passed over the surface, the grating comprising a plurality of transmissive regions arranged in a row and separated by opaque regions;

a detector coupled to the grating, the detector configured to detect whether the optical beam has passed through a transmissive region of the grating and providing a signal indicating whether the beam has passed through the grating; and an electronics module comprising:

an indicator; and a processor coupled to the detector and the indicator, the processor configured to accept the signal from the detector, calculate the speed of the treatment device, and actuate the indicator to indicate whether the calculated speed is less than, equal to, or greater than the ideal speed.

17. A method of providing feedback to an operator regarding the speed at which the operator is passing a treatment device over a surface compared to an ideal speed, the method comprising the steps of:

passing an optical beam from a reference module, coupled to the treatment device, over a sensing module, separate and spaced apart from the treatment device, as the treatment device is passed over the surface;

calculating with a processor a calculated speed at which the optical beam is being passed over the sensing module; and providing an indication of whether the calculated speed is less than, equal to, or greater than an ideal speed.

18. The method of claim 17, wherein the sensing module comprises a grating, and wherein the step of passing the optical beam over the sensing module comprises the steps of:

passing the optical beam through the grating, the grating disposed such that the optical beam strikes the grating as the treatment device is passed over the surface, the grating comprising a row of transmissive regions separated by opaque regions; and detecting with a detector whether the optical beam has passed through the one of the transmissive regions of the grating and providing a signal indicating whether the beam has passed through the grating.

19. The method of claim 18, wherein the step of calculating with a processor the calculated speed comprises the steps of:

comparing the calculated speed to the ideal speed; and actuating an indicator to indicate whether the calculated speed is less than, equal to, or greater than the ideal speed.

20. The method of claim 19, wherein:

the signal provided by the detector is approximately a square wave with a hi value transmitted when the optical beam is passing through the grating and a lo value when the optical beam is not passing through the grating; and the step of calculating the calculated speed comprises calculating a frequency from the square wave at determined time intervals.

21. The method of claim 19, wherein:

the indicator is configured to emit visible light at a selectable frequency; and the step of actuating an indicator comprises emitting light at a frequency that is monotonically related to the calculated speed.

22. The method of claim 19, wherein:

the indicator comprises a plurality of selectively illuminated indicators; and the step of actuating an indicator comprises illuminating a portion of the plurality of indicators, wherein the portion of the plurality of indicators that are illuminated is monotonically related to the calculated speed.

23. The method of claim 19, wherein:

the indicator is configured to emit sound at a selectable frequency when actuated; and the step of actuating an indicator comprises emitting sound at a frequency that is monotonically related to the calculated speed.

24. The method of claim 17, wherein the surface is interposed between the reference module and the sensing module.

* * * * *